US006962158B1

(12) United States Patent
Anguelo

(10) Patent No.: US 6,962,158 B1
(45) Date of Patent: Nov. 8, 2005

(54) HAIR DYE APPLICATOR

(76) Inventor: Michael Anguelo, 3396 S. River Dr., Miami, FL (US) 33142

( * ) Notice: Subject to any disclaimer, the term of this patent is extended or adjusted under 35 U.S.C. 154(b) by 360 days.

(21) Appl. No.: 10/361,261

(22) Filed: Feb. 10, 2003

(51) Int. Cl.[7] ..... A45D 24/22; B65D 35/18
(52) U.S. Cl. ..... 132/113; 222/192; 137/854
(58) Field of Search ..... 222/192, 105, 222/481.5, 633, 212, 215, 106; 137/526, 137/843, 861, 852, 854; 251/61.1; 132/112–114; 401/28, 138, 183

(56) References Cited

U.S. PATENT DOCUMENTS 2,173,571 A * 9/1939 Jesnig ..... 137/854
2,293,634 A * 8/1942 Sluss ..... 132/113
2,376,065 A * 5/1945 Kuszyk ..... 132/114
2,849,009 A * 8/1958 Heinrich et al. ..... 132/116
2,897,826 A * 8/1959 Di Vito ..... 132/114
3,961,635 A * 6/1976 Miya ..... 132/113
4,221,492 A * 9/1980 Boscardin et al. ..... 401/184
4,317,464 A * 3/1982 Bailey et al. ..... 132/113
5,971,024 A * 10/1999 Penny ..... 137/859
5,975,089 A 11/1999 Simon ..... 132/113
6,035,806 A * 3/2000 Lorenzo ..... 119/603
6,467,653 B1 * 10/2002 Hamamoto et al. ..... 222/105

* cited by examiner

*Primary Examiner*—Kevin Shaver
*Assistant Examiner*—Stephanie L. Willatt
(74) *Attorney, Agent, or Firm*—Jesus Sanchelima; Albert Bordas

(57) ABSTRACT

A dye applicator that has an elongated container that doubles as a handle and a comb assembly with an internal longitudinal cavity along its spine. The container is removably connected to the comb assembly to permit the dye to pass through the cavity and to the longitudinal and transversal opening in each tooth. The dye goes out to the user's hair through opening terminations on each of the transversal conduits. The container assembly is deformable to squeeze out the dye and a one-way valve is used to permit the air to replace the dye that is released.

1 Claim, 2 Drawing Sheets

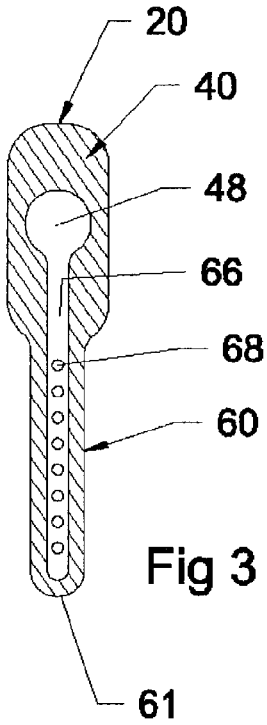
Fig 3
Fig 4
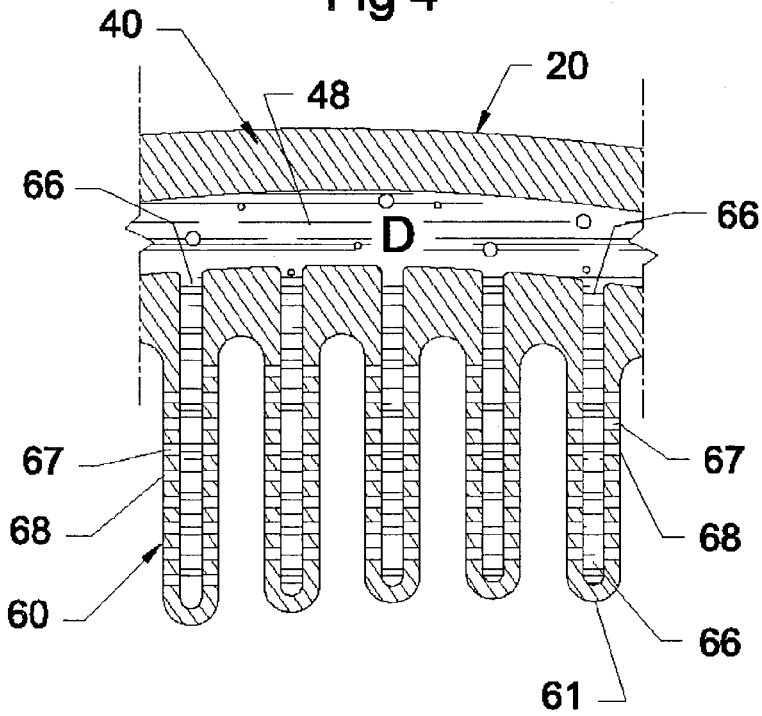
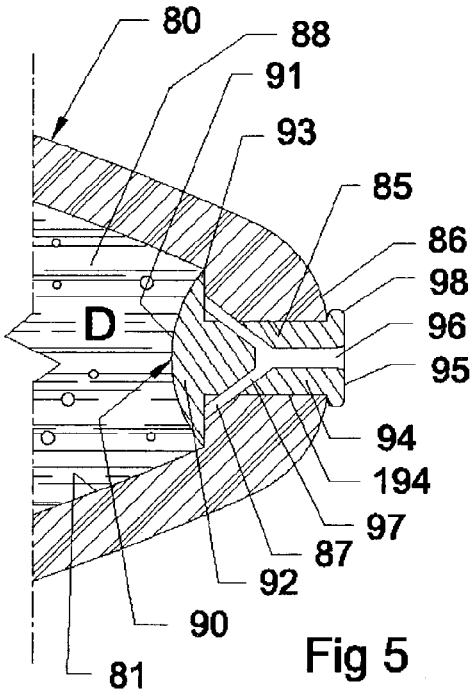
Fig 5
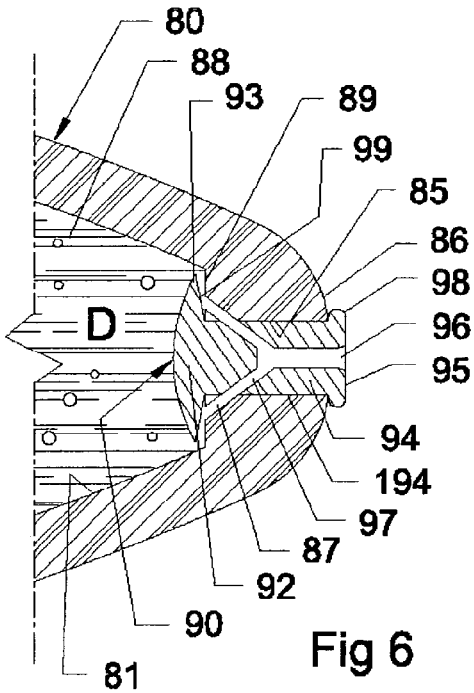
Fig 6

HAIR DYE APPLICATOR

BACKGROUND OF THE INVENTION

1. Field of the Invention

The present invention relates to a hair dye applicator, and more particularly, to such a device that includes a removable and refillable container for the dye that doubles as a handle.

2. Description of the Related Art

Several dye applicators have been developed in the past. None of them, however, includes a removable dye container to provide a continuous supply of dye to a user's hair. The hair dye applicator includes a number of parallel teeth with internal longitudinal and transversal cavities to deliver the dye through several openings cooperative disposed in the opposite sides of the teeth.

Applicant believes that the closest reference corresponds to U.S. Pat. No. 5,975,089 issued to Joseph T. Simon in Nov. 2, 1999 for a hair brush applicator. Simon's patented hairbrush applicator includes a hairbrush with a handle portion and a head portion. The handle portion has a chamber therein and the head portion has a plurality of narrow bristles and a plurality of wide bristles. Each of the wide bristles is tubular and has an open root coupled to the head portion and terminates at a closed tip. The hairbrush has a passage connecting the chamber adjacent the neck portion to the open roots of the wide bristles. Each of the wide bristles has a plurality of lateral apertures positioned between the root and tip of the wide bristle. The hairbrush has a rotatably mounted disk blocking the passage of the hairbrush. However, it differs from the present invention because the present invention includes a removable and replaceable dye container assembly preferably made out of moldable semi-rigid materials that doubles as a handle. The dye container assembly is deformable upon the applying of a force to squeeze out the dye and a one-way valve is used to permit the air to replace the dye that is released. The container maintains sufficient rigidity, even after being squeezed, to perform the handle functions. Also, the present invention includes a one-way valve that allows air to occupy the space liberated by the exiting dye.

SUMMARY OF THE INVENTION

It is one of the main objects of the present invention to provide a hair dye applicator that continuously releases the dye directly on the user's hair avoiding spills and waste.

It is another object of this invention to provide a hair dye applicator that includes a removable dye container that doubles as a handle.

It is still another object of the present invention to provide an applicator with a one-way valve that permits a user to squeeze the dye out-recuperating the original shape of the dye container upon the release of the squeezing pressure.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 illustrates a transversal cross section view taken along line 3—3 in FIG. 1.

FIG. 4 is a representation of an enlarged view of several teeth taken from FIG. 2.

FIG. 5 is an enlarged detail view of the air valve taken from FIG. 2, shown in the closed position.

FIG. 6 is an enlarged detail view of the air valve in the open position.

DETAILED DESCRIPTION OF THE PREFERRED EMBODIMENT

Figure 1:
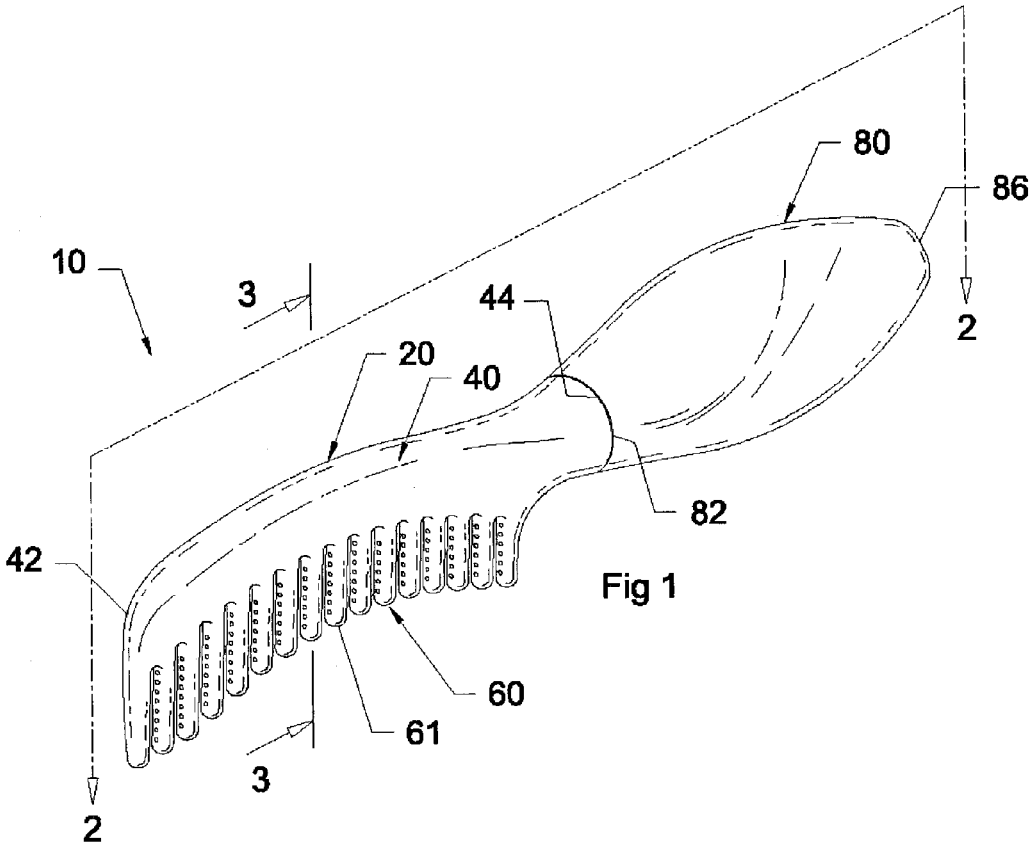
FIG. 1 represents an isometric view of the hair dye applicator, object of the present application.

Referring now to the drawings, where the present invention is generally referred to with numeral 10, it can be observed that it basically includes comb assembly 20 and dye container assembly 80, as seen in FIG. 1. The latter doubles as the handle for applicator 10. Comb assembly 20 is preferably made out of a moldable plastic material. In production, it is envisioned that two symmetrical halves are molded and mounted together. Thus, the present invention also lends itself to be mass-produced.

Figure 2:
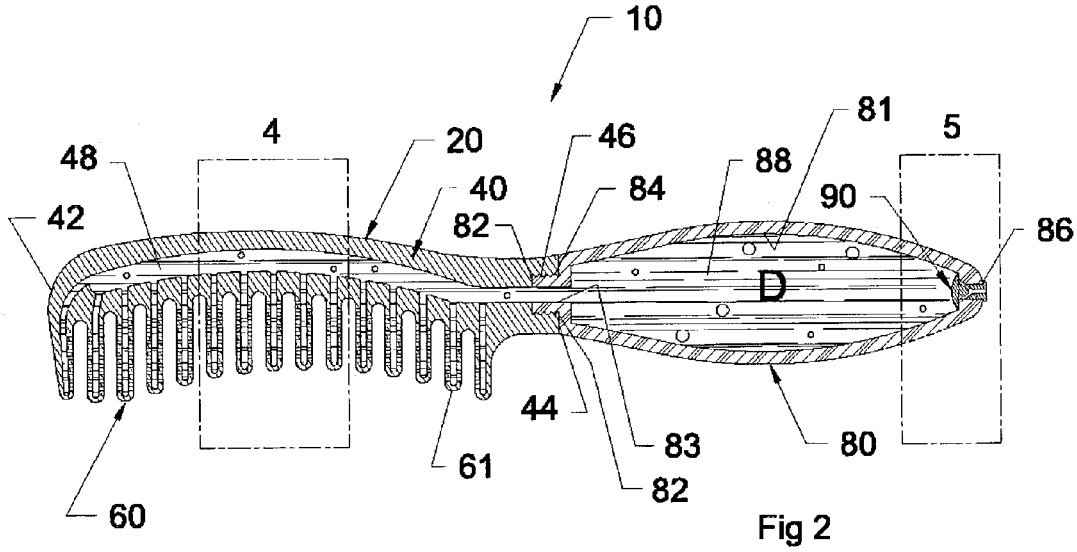
FIG. 2 shows a longitudinal cross sectional view taken along line 2—2 in FIG. 1.

Comb assembly 20 includes longitudinally extending spine member 40 and a plurality of teeth 60. Spine member 40 includes front end 42, rear end 44 and longitudinally extending cavity 48, as best seen in FIG. 2. Rear end 44 includes threaded through opening 46 that matingly receives dye container assembly 80. Internal longitudinal cavity 48 extends along spine 40 from opening 46 at rear end 44 towards end 42, without reaching the latter. Teeth 60 are perpendicularly mounted to spine member 40. Teeth 60 include closed ends 61 at their distal ends, with longitudinal conduits 66 connected to long longitudinal cavity 48. Transversal conduits 67 are perpendicularly disposed with respect to conduits 66 and connect the latter with through openings 68, as best seen in FIGS. 3 and 4. Hair dye D is released through openings 68 and deposited on the user's hair. The position of through openings 68 allows an effective distribution of hair dye D throughout the hair as a user combs it and prevents spillage during the hair coloring process.

Dye container assembly 80 is used as a handle also and is made out a semi-rigid material such as rubber or plastic. It is designed so that a user may squeeze dye D out and assembly 80 recuperates its original shape upon the release of the squeezing pressure. Dye container assembly 80 includes end 82, end 86 and internal wall 81 defining internal holding space 88 for receiving dye D. End 82 includes through opening 83 and threaded neck 84 that is removably mounted to mating threaded opening 46 of rear end 44. When a user squeezes container assembly 80, dye D is forced to go out through opening 83. End 86 includes through opening 85, passages 87 and one-way air valve assembly 90 mounted over opening 85 to facilitate the introduction of air inside space 88 when dye D passes to internal cavity 48 and subsequently to conduits 66 and 67. Passages 87 are disposed at an angle with respect to through opening 85 and connect the latter with space 88. Space 88 has internal annular end wall 89 at end 86.

In the preferred embodiment, one-way air valve assembly 90 has a substantially mushroom shape with valve head member 92 and plug body 94. Valve assembly 90 is made out of a flexible material such as rubber. Valve head member 92 includes ends 91 and 95, rim 93 and sealing surface 99 that comes in contact with internal annular end wall 89. Plug body 94 includes central through opening 96, passages 97, rim 98 and lateral wall 194. Central through opening 96 extends from end 95 a predetermined distance towards end 91. Passages 97 are connected to central through opening 96 and disposed at an angle radialy outwardly to lateral wall 194 to directly coincide with passages 87. Rim 98 extends outwardly body 94 at end 95. Rim 98 comes in contact against end 86 to keep plug body 94 in place. When container assembly 80 is deformed (squeezed) it will subsequently tend to recuperate its initial shape and air is allowed to penetrate space 88 replacing the dye D that was released. In the rest position, valve 90 is closed. The pressure that dye D exerts urge rim 93 sealing surface 99 against internal annular end wall 89, closing the entrance of passages 87, as shown in FIG. 5, and no air enters space 88 and no dye D can exit through opening 96. In the open position, the atmospheric pressure causes rim 93 to deform inwardly allowing the air to come in. Surface 99 separates from internal annular end wall 89, and the air enter from outside through opening 96, passages 97 and 87 into space 88, as shown in FIG. 6, until container 80 recuperate its initial shape.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting-sense.

What is claimed is:

1. A dye applicator, comprising:

A) a semi-rigid container assembly having an elongated shape with first and second ends and an internal wall defining an internal holding space for receiving a dye, said first end including a first opening, said container assembly being deformable upon the application of a force of predetermined magnitude and recuperates its initial shape upon releasing said force and said container assembly further including a one-way valve assembly that permits air to come inside said holding space to replace the dye that has been released when said force is released as said container assembly recuperates its at rest shape, said one-way valve assembly is mounted on said second end and said one-way valve assembly includes a plug body with fifth and sixth ends and a lateral wall with a flexible mushroom shaped head with a flexible and resilient rim, a central through opening extending from said fifth end a predetermined distance towards said sixth end and including at least one first passage that extends at an angle radially outwardly from said central through opening to said lateral wall, and said second end of said container assembly including at least one second passage cooperatively positioned to connect said first passage with said internal holding space at a predetermined position on said internal wall that cooperatively coacts with said rim to selectively close and open said second passage upon the application and release of said predetermined force deforming said container assembly; and B) a rigid comb assembly including a longitudinally extending spine member having third and fourth ends and a longitudinally extending cavity extending from said third end towards said fourth end without reaching it, said third end including a second opening and said first and third ends include mating threaded portions and said first and third ends being removably mounted to each other and said comb assembly further including a plurality of teeth perpendicularly mounted to said spine member and each of said teeth further including a longitudinal conduit connected to said cavity and a plurality of transversal conduits substantially perpendicularly connected to said longitudinal conduit and said plurality of transversal conduits terminating at third openings on each of said teeth so that said dye is permitted to flow from said holding space through said cavity to said longitudinal and transversal conduits and out through said third openings.

* * * * *